US006604690B2

(12) United States Patent
Young

(10) Patent No.: US 6,604,690 B2
(45) Date of Patent: Aug. 12, 2003

(54) CONCRETE RAIL TIE

(75) Inventor: Hartley Frank Young, Melton (AU)

(73) Assignees: Engineering Invention Pty Ltd., Victoria (AU); AirBoss Railway Products Inc., Kanasas City, MO (US)

( * ) Notice: Subject to any disclaimer, the term of this patent is extended or adjusted under 35 U.S.C. 154(b) by 107 days.

(21) Appl. No.: 10/012,357

(22) Filed: Dec. 12, 2001

(65) Prior Publication Data

US 2002/0070283 A1 Jun. 13, 2002

(30) Foreign Application Priority Data

Dec. 12, 2000 (AU) ..... PR 2033

(51) Int. Cl.[7] ..... E01B 9/00

(52) U.S. Cl. ..... 238/270; 238/83; 238/264; 238/287

(58) Field of Search ..... 238/83, 84, 85, 238/88, 270, 101, 264, 105, 115, 265, 287, 290, 291, 297, 298

(56) References Cited

U.S. PATENT DOCUMENTS

| | | | | | |
|---|---|---|---|---|---|
| 4,179,067 | A | * | 12/1979 | Baier | 238/283 |
| 4,266,719 | A | * | 5/1981 | Ortwein et al. | 238/109 |
| 4,757,945 | A | * | 7/1988 | Leeves | 238/107 |
| 5,110,046 | A | * | 5/1992 | Young | 238/283 |
| 5,485,955 | A | * | 1/1996 | Owen | 238/265 |
| 5,549,245 | A | * | 8/1996 | Kish | 238/283 |
| 5,551,633 | A | * | 9/1996 | Kish et al. | 238/283 |

* cited by examiner

*Primary Examiner*—Mark T. Le
(74) *Attorney, Agent, or Firm*—Connolly Bove Lodge & Hutz LLP

(57) ABSTRACT

A concrete railroad tie is provided which utilises a tie 1 having a peripheral rib 5, 1 mm high, around the rail seat to contain adhesive 12 to bond a thick wear plate 8 to the tie. The surface of the tie is well below the top of the plate to reduce the penetration of abrasive materials between the rail pad 13 and the plate 8. This combination inhibits abrasion of the tie for the life of the tie.

14 Claims, 5 Drawing Sheets

ENLARGED SECTION BB

ENLARGED SECTION AA

CONCRETE RAIL TIE

TECHNICAL FIELD

This invention relates to a rail fastening assembly of the type where a rail is clamped to a concrete rail seat by elastic rail fasteners held in shoulders cast into the concrete tie and an elastomeric pad is used between the bottom of the rail and the concrete rail seat. An optional abrasion plate may be fitted between the bottom of the pad & the top of the rail seat. The present invention addresses the problem of wear on the concrete surface where the rails sit on the tie.

BACKGROUND

Concrete ties have been in use in some parts of the world for a long time but it is only since 1985 that they have been able to provide cost benefits for use in North America relative to wooden ties.

Some of the advantages of concrete ties over wooden ties in USA are:

1. Improves track stability
2. Lower track maintenance costs
3. Fewer derailments
4. In some cases higher axle loads & travel speed have been possible.
5. Overcomes the problems of finding environmentally safe methods of treating wood ties to prevent termite damage.
6. Releases a large amount of structural quality timber for more appropriate use.
7. Eliminates the difficulty of finding environmentally safe ways to dispose of used chemically treated wooden ties.

The usage of concrete ties in USA has progressively increased and the benefits listed above have been confirmed.

However in 1988 a previously unknown problem was found. Ties which had been in use for only 1 year in some heavy traffic locations began to show wear on the rail seat. The cement paste was being worn away leaving the stones in the concrete upstanding as a diamond in a ring is held by a clasp at the bottom. As time progressed it was found that as the cement paste continued to be eroded the stones finally came out & the process continued on the layer below. After a few years in some extreme locations the damage was so bad that the rails began to tilt outwards thereby increasing the distance between the rail heads and if allowed to continue would eventually lead to a derailment. In extreme cases the wear on the rail seat outer edge was 10 mm or more. One of first inventions aimed at solving the rail seat erosion problem was by Buekett U.S. Pat. No. 4,925,094 and he used a stainless steel plate cast into the surface of the rail seat and the plate had legs which extended into the concrete to secure it in the rail seat.

There are two problems with this approach apart from the high cost and these are caused by the very weak bond of concrete to steel and the difference in elasticity between steel & concrete. Most concrete ties are prestressed by steel tendons in the tie and when the stress is applied the tie shortens about 1.3 mm and at the end of the first year the steady compression stress causes the tie to creep and the length shortens approximately by an additional 1.5 mm to give a total shortening of about 2.8 mm. Since the modulus of elasticity of steel is about 6 times greater than for concrete there will be slight differential movement between the concrete close to the bottom of the plate and the steel plate itself and the weak bond between the bottom of the steel plate will be broken by the resulting shear forces.

Buekett overcame this problem by providing legs at the ends of the plate which are embedded in the concrete to give a mechanical connection to the concrete so that there is no structural need for a perfect cement paste bond. When the track loads are applied to the tie the rail seat area will flex slightly and the difference in elasticity will further increase the likelihood of a cement paste bond failure below the plate.

A solution to the problem was provided by U.S. Pat. No. 5,110,046 (Young) and this is still the main method in use for controlling the problem. Tie rail seats are protected by using a thin steel abrasion plate about 1 to 1.5 mm thick on top of a closed cell foam gasket & used ties are repaired by bonding the abrasion plate onto the rail seat with epoxy. When Young devised his first solution it was necessary to make the system work with existing rail seats & rail fastening systems which placed limits on what could be done. For example the original steel abrasion plates were 0.9 mm thick and they were subsequently increased to 1.4 mm but this is the limit that the rail fastenings can cope with since the plate lifts the rail above the originally intended position.

However although the method works time has shown that in some cases it will not last for the life of the tie & the rail seats will need to be repaired in track which is inconvenient and expensive.

At the time Young conceived the original invention he thought that that the wear mechanism driving the problem was caused by the movement of the elastomeric pad between the bottom of the rail and the surface of the concrete rail seat. When each loaded axle passes over the rail above the rail seat a load pulse is transmitted through the pad to the rail seat which causes the elastic pad to deflect vertically & due to the Poisson's ratio of the material it must also deflect horizontally and this horizontal rubbing action was thought to cause the problem in the presence of sand particles. This is described in U.S. Pat. No. 5,110,046.

A number of subsequent attempts to improve the inhibition of rail seat erosion relied on the same insights as Young and also utilised the thin plate solution.

U.S. Pat. No. 5,405,081 uses an impervious polymeric membrane between the rail pad and rail seat.

U.S. Pat. No. 6,045,052 uses an abrasion plate having a polymer coating on the bottom which is thicker around the edges than in the center in order to accommodate irregularities in the rail seat. This is intended to work by the thicker band around the periphery being subject to more pressure and thereby providing a water tight seal while the slight cavity in the central region gives room to accommodate irregularities.

This principle has been tested on rubber and polyurethane pads. A downward projecting band was used around the pad periphery on the bottom which acted as a seal. This worked initially but as the load pulses were applied the sealing band deflected according to Poisson's ratio as described by Young (U.S. Pat. No. 5,110,046) and a slight rubbing action occurred under the band which eventually caused one small part not to seal effectively and pumping started.

U.S. Pat. No. 5,549,245 Utilizes a metal plate with a rail pad bonded on the top side and the assembly is bonded to the rail seat by a methyacrylate ester adhesive. This adhesive bonds rapidly which is an advantage over epoxy resins and other adhesives. In addition this arrangement overcomes the problem of pumping and micro jetting so long as the bond remains effective. One major disadvantage of this system is that where there is heavy rail traffic and curves the pads need to be replaced periodically which is difficult because they are bonded to the tie. Another problem is that in some situations the bonds have been known to fail which may be the result of the rail seats being damp when the bonding was done. However in many locations particularly in the mountains the ties are frequently damp.

Another patent which addresses the use of rail plates with concrete ties is WO 01/36749 which discloses a plate having a central hole for insertion of a polyurethane buffering pad.

It is an object of this invention to provide a rail seat assembly for concrete ties which inhibits erosion of the ties for the useful life of the tie.

SUMMARY OF THE INVENTION

To this end the present invention provides a railroad tie and rail seat assembly for supporting a rail which includes a) a concrete rail tie having at least one rail seat defined by a shallow recess
b) a rail plate seated over said recess so that the peripheral edges of the plate extend at least to the edges of said recess
c) polymeric adhesive within said recess to bond said plate to said tie
d) an optional rail pad on said plate adapted to lie beneath the rail flange.

This invention is predicated on the better understanding of the causes of rail seat erosion as set out below.

The concrete rail seats usually have a flatness tolerance set by the railroads and the tie manufacturers always try to make the seat as flat as possible without going to costly extremes.

Although from a practical point of view the rail seats may be classified as "flat," they are still not perfectly flat so when the elastic clips apply a combined force of 4800 Lbs to the rail it is usually not sufficient to provide intimate contact over the whole area of the rail seat even though the pad has considerable elastic properties. This means that inevitably there are shallow cavities in some interface regions.

Overnight dew or light rain causes water droplets to form and accumulate around the periphery of the pad or plate and the water then travels into the interface by capillary action. The moisture either travels through the surface of the concrete or through the dust layer on the surface and collects in the shallow cavities. Where the shallow cavity has an entry at the periphery of the pad or plate then the moisture travels directly into the cavity.

When the loaded axle passes over the rail seat the vertical load then suddenly increases from the 4,800 lbs provided by the rail clips to 18,000 lbs or more which is normally sufficient to deflect the rail pad & abrasion pad until the shallow cavities are closed. The water in the cavities is then subject to hydraulic pressure which will sometimes cause it to flow sideways to any adjacent position where the pressure is less. Since the micro jets so formed usually carry some dust particles they then erode the cement paste in the concrete. The erosion process is usually slow at first but accelerates, as the size of the recesses are increased by the removal of the cement paste, so that they then can contain more water and abrasive particles and the pumping cell becomes larger and more damaging. It is now known that a depression cavity as small as 0.1 mm is sufficient to become a pumping cell and start the erosion process. None of the prior art attempts to address this problem were able to fully deal with this erosion mechanism. For example Buekett, mentioned above, moulded a legged rail plate into the tie. While a bond failure below the plate has no structural consequences if the plate is anchored by legs it is likely that water will find its way into this crack line and as the axle loads are applied to the top of the plate water pumping & micro jetting will commence below the plate.

Once pumping starts the size of the crack or cavity will increase and hold more water. If the fissure extends over a large area of the plate then when the water freezes there will be a very large ice up thrust which the plate legs must resist and as they stretch elastically, the cement bond around the legs at the top will fail first and progressively move downward. Eventually the legs will be a loose mechanical fit in the concrete and the plate will move in the concrete, exaggerating the pumping problem. At first all of this damage will occur below the concrete and will not be visible but when it does become apparent the damage will be at an advanced stage.

This invention also provides a novel way of bonding a galvanized steel wear plate to the rail seat in a manner which will overcome the problems associated with rail seat erosion and the plate can be made thick enough to have a very long wearing life—preferably lasting for the life of the tie so that no rail seat repairs will be needed after the tie has been placed in service.

In this further aspect the present invention provides a rail road tie which has a) at least one rail seat located between two rail clamp support shoulders embedded in said tie
b) said rail seat being defined by a shallow recess adapted to lie beneath a rail plate
c) said rail clamp support shoulders being positioned in said tie so that the thickness of the rail plate and rail pad can be accommodated.

In addition the wear plate can be applied to the tie at the tie plant without excessive costs which is far more convenient and cost effective than bonding plates to the ties in track as is currently done.

The interface between the bottom of the pad and the top of the wear plate is preferably elevated above the general rail seat so that light rain and dew will drain away from the interface to minimize the water and fine dust that reaches the wearing surfaces of the interface, thereby reducing the wear rate relative to currently used rail seats. In addition the wear plate preferably does not normally extend beyond the edges of the rail and the rail pad projects well beyond the wear plate to drain water clear of the interface.

A suitable adhesive is used to bond the wear plate to the rail seat. This adhesive must have the following properties.

1. Capable of bonding galvanized steel to damp concrete
2. The bond strength must exceed the strength of the concrete so that if the wear plate is torn off after the adhesive has cured the fracture will occur mainly in the concrete rather than at the joint line.
3. A viscous nature before curing.
4. High compressive strength when used in a thickness of approximately 1 mm and adequate compression strength is retained up to at least 140° F.
5. Slight flexibility in the cured state when a thickness of approximately 1 mm is used.
6. Good fatigue strength.
7. Impervious to water after curing and not damaged by water on the surface of the cured adhesive.
8. Not affected by oil & grease after curing.
9. Fast curing time.
10. Not subject to brittle fractures at sub zero temperatures
11. Some plastic flow and creep before fracture.

Epoxy adhesives are available that fulfill these requirements.

The bonding adhesive layer is made 0.5 to 3 mm thick preferably about 1 mm thick so that it will have sufficient flexibility and plastic flow capability to accommodate very small horizontal relative movement between the steel plate and concrete.

This relative movement is due to concrete creep deflection and the difference in the modulus of elasticity between steel and concrete causing different deflections under load.

A shallow depression of the required adhesive thickness (0.5 mm to 3 mm preferably about 1 mm) is obtained by placing a narrow rib around the sides of the rail seat periphery. These ribs are about 1 mm or the preferred adhesive thickness high so that when the wear plate is placed on top of the ribs an adhesive chamber of the required thickness is formed under the main body of the plate. The ribs are preferably moulded into the surface of the tie or alternatively the recess may be formed as a shallow depression in the tie surface. It is preferred that the ribs are integral with the tie surface but non integral ribs such as a strip of wire or plastic of the appropriate thickness and shape in placed on the tie surface to create the necessary adhesive recess.

Each rib preferably has associated with it several vertical projections just outside of the plate seating area to locate the plate correctly when the adhesive is being applied and cured.

Rail seats on concrete ties are normally inclined at a slight angle to the horizontal so that the rails tilt together slightly. The angle varies between some rail roads and angles of 1 in 30, and 1 in 40 are common. The side of the rail seat nearest to the center of the tie is the lowest side and is called the "gauge side" and the side of the seat nearest to the tie end is called the "field side" and is the high end of the rail seat.

A wear plate having one or two holes at the gauge side is positioned in the seat. It is temporarily clamped in place. Then a suitable adhesive is injected into the seat through the holes in the low end of the plate and the adhesive injection continues until a small amount of adhesive appears in spillway channels at the high end of the seat thus proving that the adhesive chamber is completely filled. The risk of trapping air bubbles in the adhesive is reduced by injecting the epoxy at the low end and allowing the air to flow out of the high end. Of course in production the adhesive would be mixed by machine and injected in a measured dose. When the adhesive injection is complete the plate clamp and injection nozzles are removed.

The initial set of the adhesive takes place in about 30 minutes and during this time there is little or no leakage of the adhesive back through the injection holes in the wear plate due to the viscous nature of the adhesive.

The wear plate is made from flat high carbon steel sheet preferably about 6.4 mm thick. Although the best wear resistance is obtained by heat treating the steel this is not done because this will inevitably cause slight bowing of the plates and the plates need to be flat to sit properly on the rail seat ribs.

It is known that good wear resistance can be obtained from high carbon steel "as rolled" so this is used to ensure that plate flatness can be controlled economically. Since the ribs on the rail seat are 1 mm high and the wear plate is 6.4 mm thick then the wearing face of the plate is 7.4 mm above the general rail seat which provides adequate drainage for light rain and overnight dew. Of course heavy rain and melting snow will still flood the seat but the elevated rail seat and overlapping pad will still significantly reduce the total time when water is available to enter the wearing interface and thereby reduce the wear on the plate.

BRIEF DESCRIPTION OF THE FIGURES

A preferred embodiment of the invention will now be described with reference to the drawings in which.

DETAILED DESCRIPTION OF THE INVENTION

Figures 1, 2, 3:
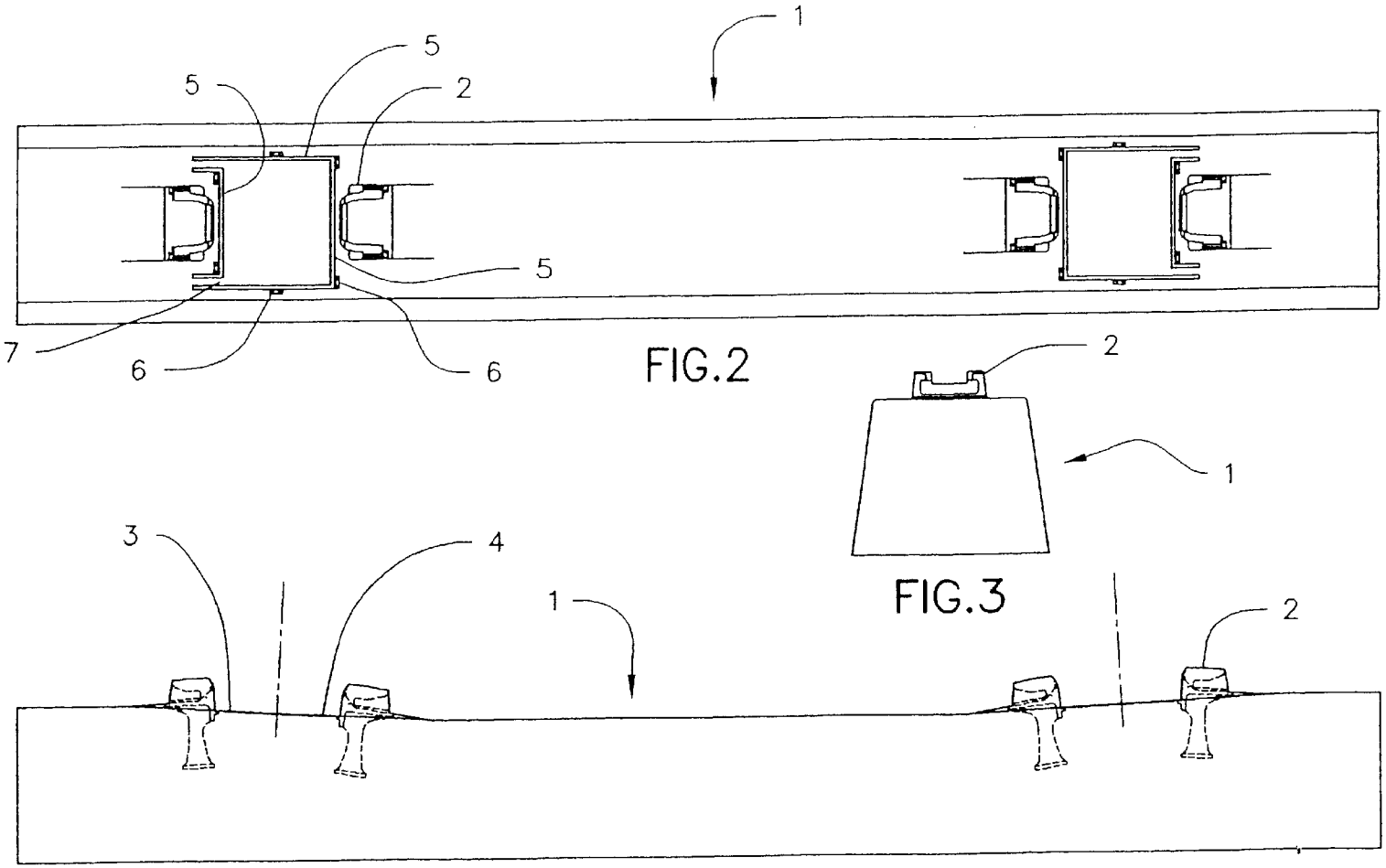
FIG. 1 is a side elevation of a typical concrete tie with the preferred embodiment of this invention
FIG. 2 is a plan view of a typical concrete tie with the preferred embodiment of this invention
FIG. 3 is an end elevation of a typical concrete tie with the preferred embodiment of this invention

FIGS. 1, 2 & 3 show the tie 1 and a typical shoulder 2.

In FIG. 1 the inclined rail seats can be seen the high end 3 of the seat is on the field side and the low end 4 is on the gauge side.

A concrete rib 5 about 1 mm high and 5 mm wide is provided around the periphery of the rail seat which then forms a shallow recess in the central part of the seat.

FIG. 2 shows the ribs 5 on four sides of the seat and two spillway channels 7 can be seen on the field side. Six vertical projections 6 are provided to locate the wear plate laterally when it is applied.

Figure 4:
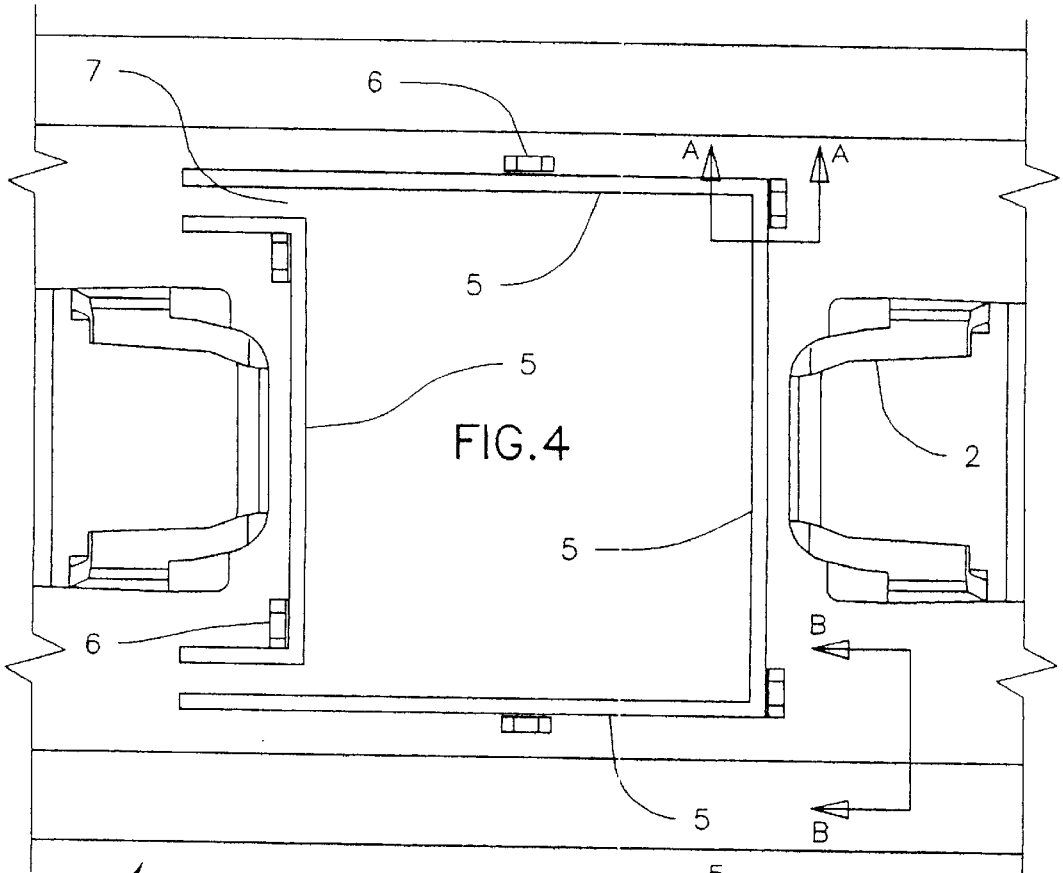
FIG. 4 is a plan view of one rail seat of the concrete tie rail seat showing details of the invention.

FIG. 4 shows a close up plan view of one rail seat and all of the features of the rail seat shown in FIG. 2 are shown again but to a larger scale.

Figure 6:
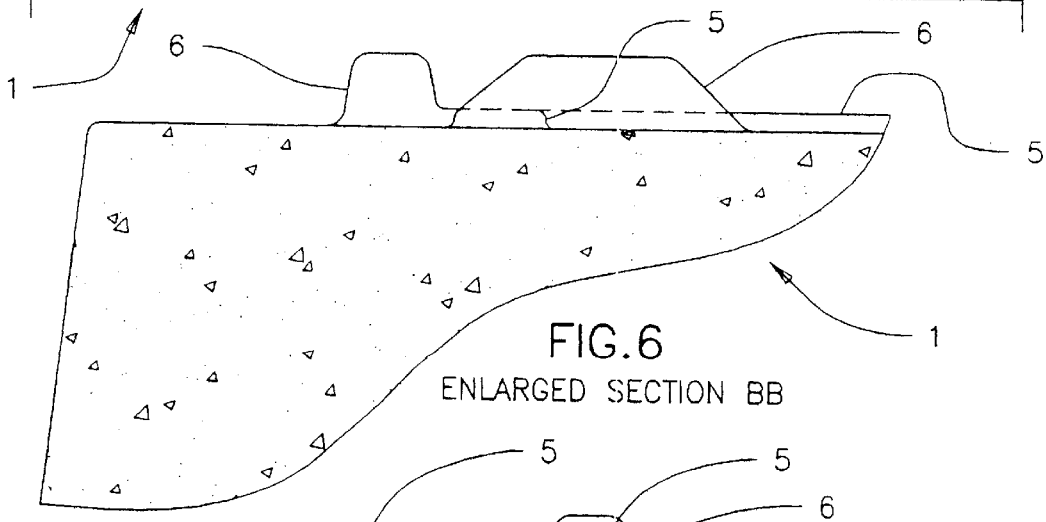
FIG. 6 is an enlarged section BB of the rail seat shown in FIG. 4
Figure 5:
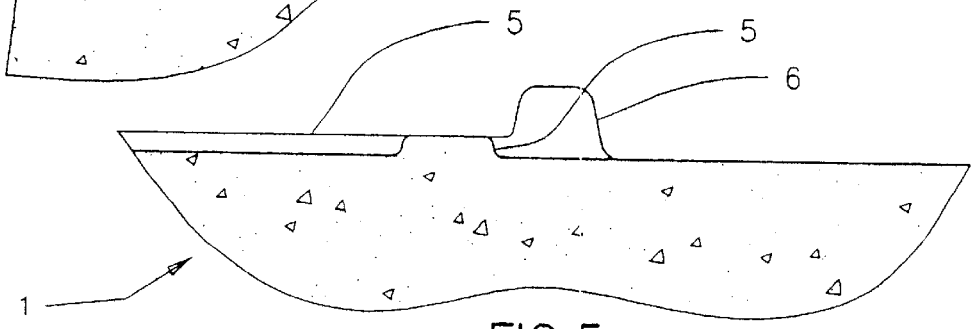
FIG. 5 is an enlarged section AA of the rail seat shown in FIG. 4

The enlarged sectional views FIG. 5 and FIG. 6 clearly show the peripheral ribs 5 and the vertical locating projections 6.

Figure 8:
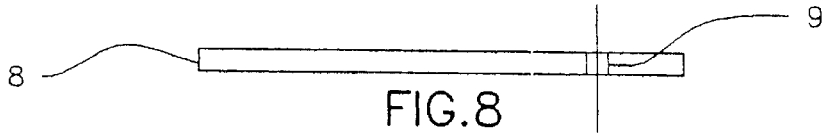
FIG. 8 is a side elevation of the wear plate by itself.
Figure 9:
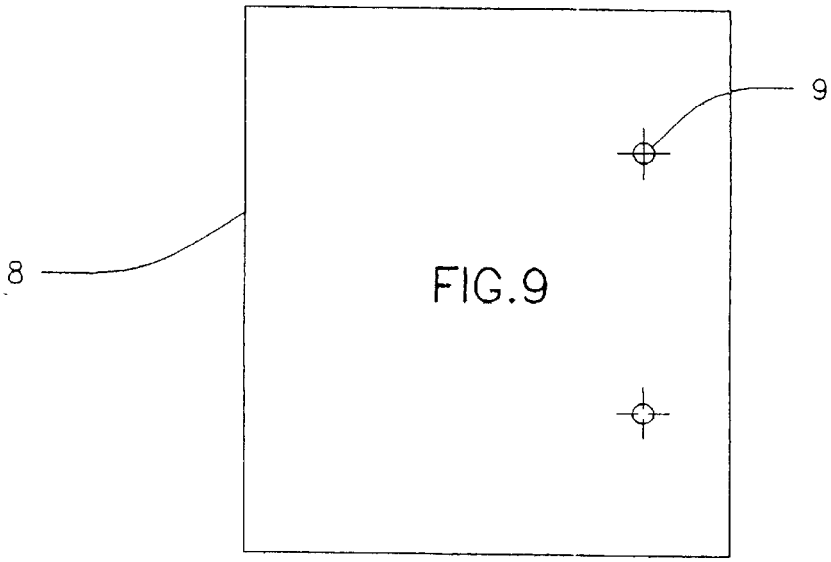
FIG. 9 is a plan view of the wear plate by itself.

FIGS. 8 and 9 show the wear plate 8 and the injection holes 9 through which the adhesive is injected. This plate is made from high carbon steel plate such as AISI C1070 or AISI C1080 and galvanized to prevent corrosion. It is important to keep the plates flat so that they will sit properly on the raised ribs and for this reason the plate is not normally heat treated since plates tend to bow in this process unless they are press quenched which is expensive. High carbon steel plate has reasonably good wear resistance in the "as rolled" state and it is estimated that a wear plate 6.4 mm thick made from this material would last for the life of the tie when used in the configuration of this invention.

Figure 7:
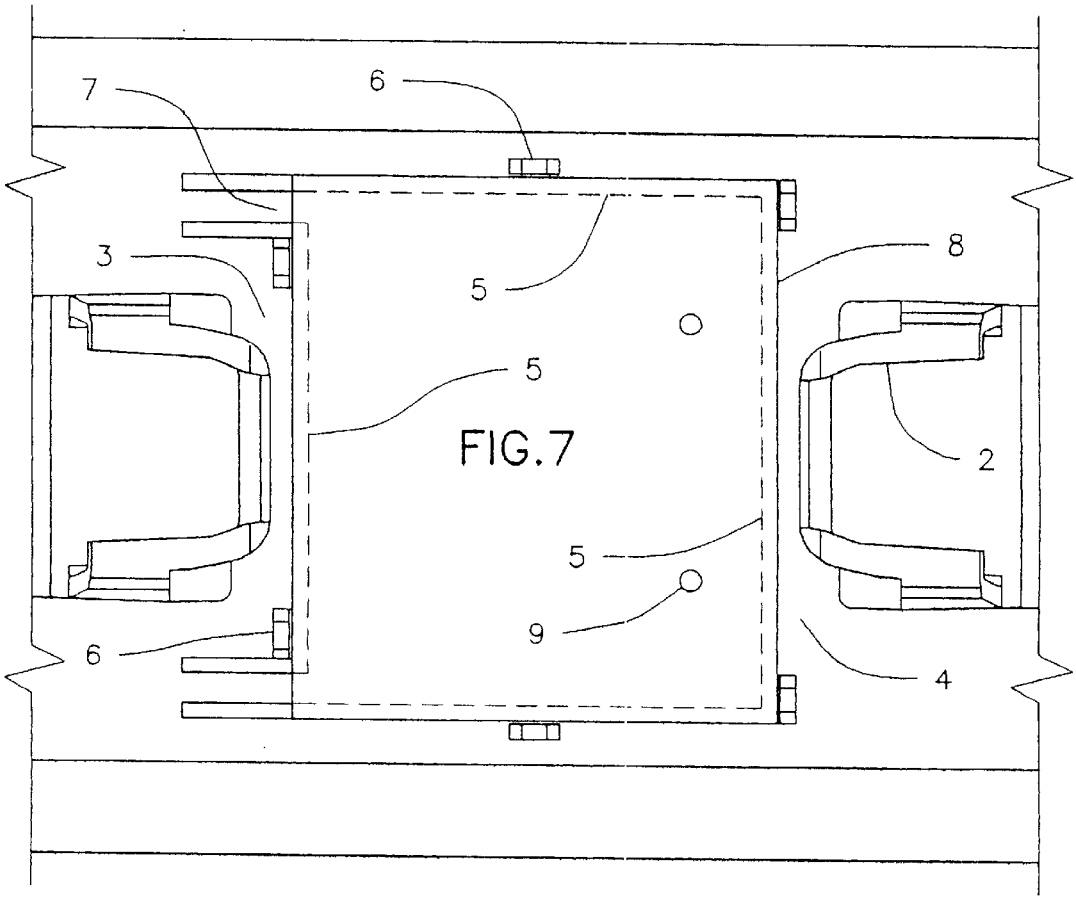
FIG. 7 shows one rail seat of the tie with a wear plate in place.

FIG. 7 shows a plan view of the rail seat as depicted in FIG. 4 with the wear plate 8 in place. The vertical locating projections 6 are keeping the plate in position laterally and clamps (not shown) would be used to hold the plate down on to the peripheral ribs while a viscous adhesive is injected through the holes 9 in the plate 8. The clamps are needed since considerable hydraulic pressure is required to force the adhesive through the plate holes and to fill the shallow recess under the plate and without clamps the pressure would lift the plate off the peripheral ribs 5. However once the adhesive flow stops the pressure falls to zero and the clamps can be removed.

The requirements for a suitable adhesive have been described above and epoxy adhesives are available which meet these requirements However other types of adhesive that meet those requirements may be used.

The adhesive is injected through the holes 9 which are on the low side of the rail seat 4 (gauge side) and the cavity under the plate is progressively filled towards the high side 3 (field side). This forces the air to flow ahead of the adhesive and out of the spillway channels 7 with a minimum number of air bubbles being trapped in the adhesive. Once the adhesive starts to flow out of both spillway channels 7 as a witness that the cavity under the plate is completely filled, then the flow is stopped. Preferably the adhesive is dispensed with automatic mixing equipment capable of injecting appropriate measured doses.

The adhesive needs to be viscous so that there is no significant leakage on the low side 4 during the time it takes for initial setting which would be about 30 minutes.

The bond strength needs to be at least equal the strength of the concrete but preferably it should be greater so that if the plate is forcibly removed the fracture is in the concrete rather than in the adhesive . This ensures that any moisture in the concrete will not break the bond when freezing occurs.

Adhesive may not fully cover the tops of the ribs 5 so this will be a partially bonded surface which may fill with moisture but the ribs are narrow so the area will be small and any expanding ice forces will easily be carried by the main body of the plate which is securely bonded to the seat.

Figure 10:
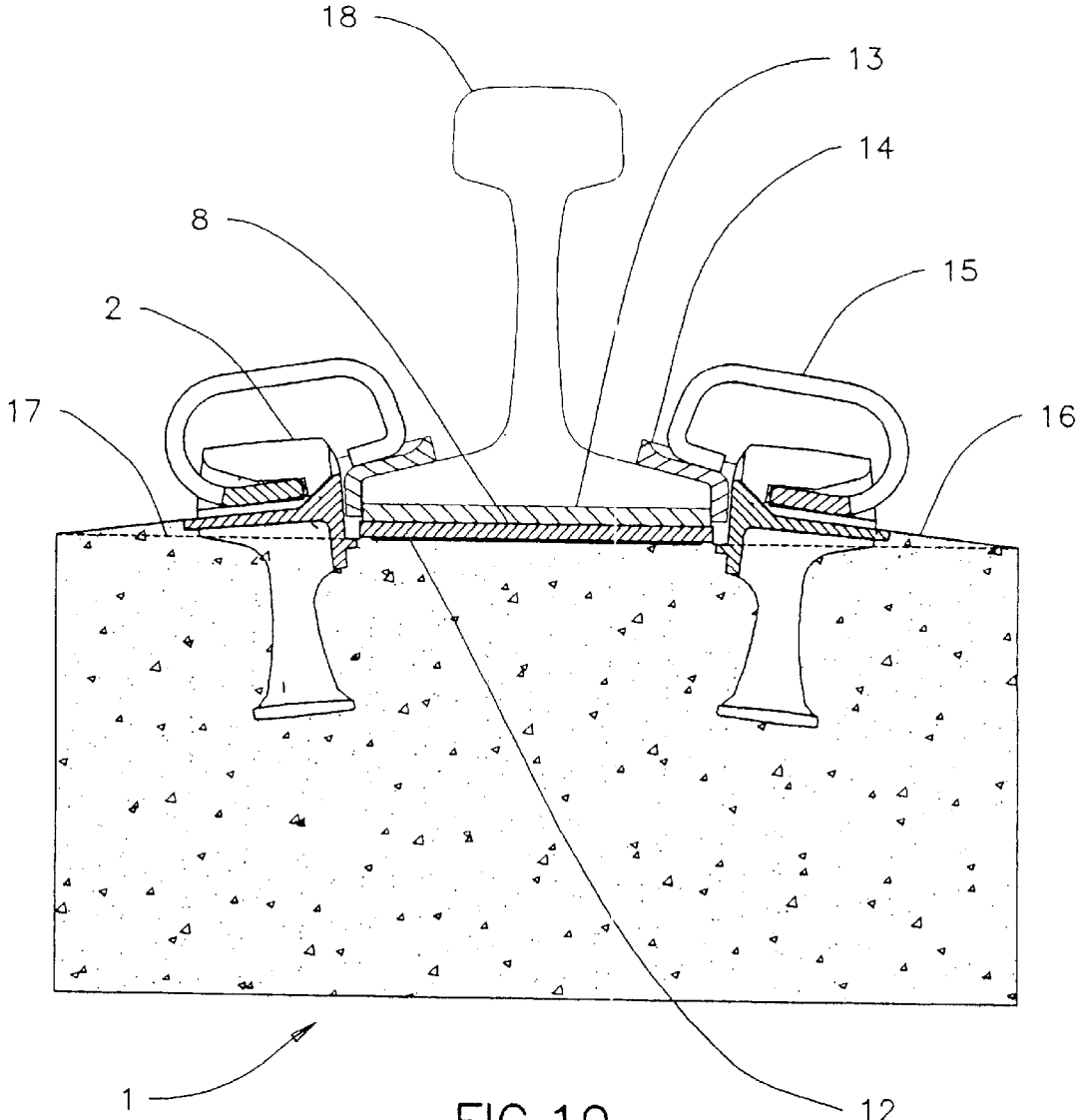
FIG. 10 is a section through the rail seat including a typical complete rail fastening system.

FIG. 10 is a cross section through the rail seat showing a typical complete rail fastening system with the wear plate 8 seating on the bonding epoxy layer 12 which is about 1 mm thick. The elastic rail fastener 15 is electrically insulated from the rail 18 by insulators 14 and elastomeric rail pad 13. Behind each shoulder there is a ramped concrete section 16 to ensure that there is adequate support for the shoulder 2 in resisting lateral loads transmitted from the rail to the shoulder. The critical wearing interface between the wear plate 8 and the elastomeric rail pad 13 is 7.4 mm above the general rail seat level 17 which gives good water drainage. Note that the scale of this drawing is too small to be able to clearly see the peripheral ribs.

Figure 11:
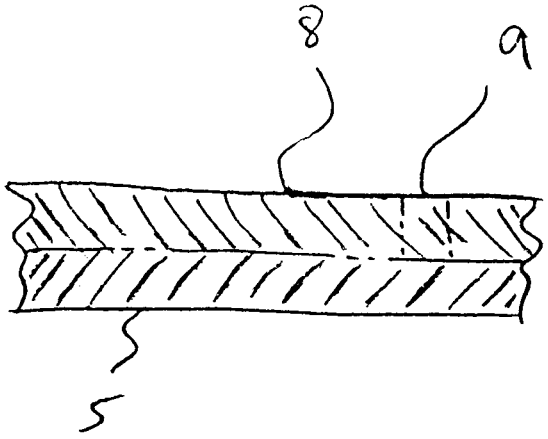
FIG. 11 is an alternative embodiment; wherein, the ribs extend downwardly from the wear plate.
Figure 12:
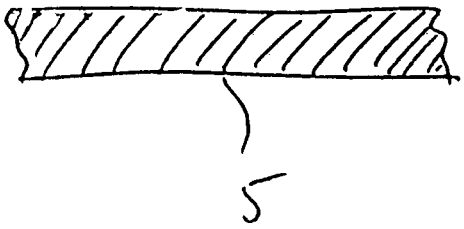
FIG. 12 is a further embodiment; wherein, the ribs are separated from the rail seat.

FIG. 11 shows ribs 5 extending downwardly from wear plate 8, and FIG. 12 shows a rib, which is separated from the rail seat.

What is claimed is:

1. A railroad tie and rail seat assembly for supporting a rail and comprising:

a) a concrete rail tie having at least one rail seat;

b) a wear plate extending over said rail seat;

c) peripheral ribs between the rail seat and the wear plate defining an adhesive cavity that is co-extensive with said wear plate so that peripheral edges of the wear plate extend to the ribs defining said adhesive cavity; and d) polymeric adhesive within said cavity to bond said wear plate to said rail tie.

2. An assembly as claimed in claim 1 wherein the cavity, in the rail seat is formed by the ribs on the rail seat for carrying the wear plate on top of the ribs so that the cavity below the wear plate is filled with the adhesive to bond the wear plate to the rail seat.

3. An assembly as claimed in claim 1 wherein gaps are provided in the ribs to form spillways for excess adhesive to escape through.

4. An assembly as claimed in claim 1 wherein the. cavity is formed by downwardly extending ribs on the wear plate, and the ribs seat on a surface of the rail tie.

5. An assembly as claimed in claim 1 wherein the peripheral ribs are separated from the rail seat and sit on top of said rail seat that is substantially flat.

6. An assembly as claimed in claim 1 wherein the adhesive cavity is 0.2 to 3 mm deep.

7. An assembly as claimed in claim 1 wherein the plate is 4 to 10 mm thick.

8. An assembly as claimed in claim 1 wherein the wear plate does not extend beyond edges of a rail base.

9. An assembly as claimed in claim 1 wherein the wear plate extends extend beyond edges of a rail base.

10. An assembly as claimed in claim 5 where vertical projections are provided in the rail seat to locate the wear plate laterally prior to bonding the plate to the rail seat.

11. An assembly as claimed in claim 1 wherein upper surface of the plate is sufficiently raised above the surface of the tie to reduce the ingress of water or other abrasion causing materials between the plate and the rail pad.

12. An assembly as claimed in claim 1 wherein the plate is of sufficient thickness and composed of sufficiently abrasion resistant material to remain functional for the life of the tie.

13. An assembly as claimed in claim 1 which has d) Said rail seat located between two rail clamp support shoulders embedded in said tie;

e) said cavity being a shallow recess adapted to lie beneath, a rail plate; and f) said rail clamp support shoulders being positioned in said tie so that the thickness of the rail plate and a rail pad can be accommodated.

14. An assembly as claimed in claim 13 wherein the recess is 0.2 to 3 mm deep.

* * * * *